US008800890B2

(12) United States Patent
Tanus

(10) Patent No.: US 8,800,890 B2
(45) Date of Patent: Aug. 12, 2014

(54) COLORPOINT PROCESS

(75) Inventor: Abraham Tanus, Weslaco, TX (US)

(73) Assignee: Woodcrafters Home Products, LLC, Weslaco, TX (US)

( * ) Notice: Subject to any disclaimer, the term of this patent is extended or adjusted under 35 U.S.C. 154(b) by 315 days.

(21) Appl. No.: 12/847,487

(22) Filed: Jul. 30, 2010

(65) Prior Publication Data

US 2011/0023222 A1 Feb. 3, 2011

Related U.S. Application Data

(60) Provisional application No. 61/230,460, filed on Jul. 31, 2009.

(51) Int. Cl.

| | |
|---|---|
| ***B05B 7/08*** | (2006.01) |
| ***B05B 7/12*** | (2006.01) |
| ***B05B 7/24*** | (2006.01) |
| ***B05B 7/02*** | (2006.01) |
| ***B05B 15/02*** | (2006.01) |
| ***B05C 5/00*** | (2006.01) |
| *B05D 1/34* | (2006.01) |
| *B05D 1/02* | (2006.01) |

(52) U.S. Cl.
USPC ..... 239/306; 239/112; 239/294; 239/304; 239/418; 239/DIG. 14; 118/300; 427/426

(58) Field of Classification Search
USPC ..... 239/104, 106, 112, 290, 294, 296, 303, 239/304, 306–308, 329, 331, 332, 398, 418, 239/426, 428, 433, 434, DIG. 14; 427/421.1, 426; 118/300, 302
See application file for complete search history.

(56) References Cited

U.S. PATENT DOCUMENTS

| | | | | |
|---|---|---|---|---|
| 4,824,017 | A * | 4/1989 | Mansfield | 239/9 |
| 4,975,303 | A * | 12/1990 | McKinnon | 427/263 |
| 5,060,860 | A * | 10/1991 | Megerle | 239/67 |
| 5,810,254 | A * | 9/1998 | Kropfield | 239/61 |
| 6,319,559 | B1 * | 11/2001 | Makino | 427/422 |
| 6,383,572 | B1 * | 5/2002 | De Graaf et al. | 427/427.2 |
| 2004/0121082 | A1 * | 6/2004 | Dunnous et al. | 427/421 |

OTHER PUBLICATIONS

Official Action dated Apr. 8, 2013 from Mexican Patent Office, Mex. Pat. Appln. No. MX/a/2010/008441, filed Jul. 30, 2010, including Translation thereof.
Official Action for Mexican Patent Application No. MX/a/2010/008441, Office action dated Dec. 17, 2013.
Response to Official Action filed Feb. 26, 2014, for Mexican Patent Application No. MX/a/2010/008441.

* cited by examiner

*Primary Examiner* — Darren W Gorman
(74) *Attorney, Agent, or Firm* — Calfee, Halter & Griswold LLP

(57) ABSTRACT

An apparatus and method for creating a realistic granite or other pattern on a substrate, such as a sink, bath, or piece of furniture. The apparatus and method may use gelcoat to create a regular or irregular pattern. The apparatus may use pressurized air or gear pumps to pump paint from tanks to a spraying device.

10 Claims, 4 Drawing Sheets

Process variables

| | | |
|---|---|---|
| 1. | Viscosity | 1,850 – 3,500 |
| 2. | Density | 1.1 – 1.5 |
| 3. | Tixotropy | 5.5 – 7.5 |
| 4. | Temperature | 26°C – 30°C |
| 5. | Air pressure | 80-110 PSI |

Figure 2

COLORPOINT PROCESS

CROSS-REFERENCE TO RELATED APPLICATIONS

This application claims priority under 35 U.S.C. §119(e) to provisional U.S. Patent Application No. 61/230,460, filed on Jul. 31, 2009, the disclosure of which is expressly incorporated by reference herein in its entirety.

BACKGROUND OF THE PRESENT DISCLOSURE

1. Field of the Present Disclosure

The present disclosure is directed to an apparatus and method for producing a high-quality simulated granite finish on a surface, such an article of furniture, a countertop, sink, lavatory, bath, wall hanging, urinal, bidet, hot tub, whirlpool bath, or the like.

2. Related Art

Stone has been used as a building material for thousands of years. Because of the natural beauty of materials such as granite and marble, they give a room a grand and luxurious appearance. However, such materials are expensive. Moreover, these materials are also limited to generally flat applications, such as floors, walls, and countertops, as it is generally too expensive, for example, to carve a sink out of a piece of marble.

For this reason, man-made materials like engineered stone and cultured marble are typically used to create non-planar fixtures. Cultured marble and engineered stone can be easily molded to create bathtubs and sinks, but these materials are almost as expensive as their natural counterparts. Furthermore, both natural and man-made stone materials are typically too heavy to be used for common pieces of furniture, such as a coffee table, bathroom vanity, or the like.

Such articles of furniture are typically made from wood, which is generally much lighter and more easily machined than stone. The wood used in such furniture is either natural wood, such as oak or pine, or a man-made composite, such as plywood, particle board, or medium density fiber board. Natural wood often has its own beauty and is stained to enhance its appearance. Composite materials, on the other hand, are not considered attractive in their own right and often have some type of laminate surface finish, either a simulated wood grain or a solid color.

Accordingly, there is an unmet need for a product that combines a light weight, low cost, and easily machinable substrate with the beauty and elegance of natural stone or other pattern.

SUMMARY OF THE PRESENT DISCLOSURE

The present disclosure meets the foregoing need and allows the creation of a beautiful, durable granite or other pattern on virtually any surface using a unique gelcoat process, which results in a unique combination of features and other advantages apparent from the discussion herein.

Accordingly, in one aspect of the present disclosure, a method for applying a gelcoat to a substrate includes supplying paint directly to a spraying device; spraying the paint onto a substrate to create a background color; supplying another paint, in smaller amounts relative to the first paint, to the outflow of the spraying device; and spraying the second paint onto the substrate to form color points on the background color.

The method may include supplying a third paint, in smaller amounts relative to the first paint, to the outflow of the spraying device and spraying the third paint onto the substrate to form color points on the background color. The method may also include supplying a catalyst to the spraying device and spraying the catalyst onto the paint on the substrate. The method may be used to apply a coating to a sink, a lavatory, a bath, an article of furniture, a bidet, a urinal, a hot tub, or a whirlpool.

According to another aspect of the present disclosure, an apparatus for applying a gelcoat to a substrate includes a spraying device, an air source for supplying pressurized air to the spraying device, a first tank supplying paint directly to the spraying device, and a second tank providing paint to the outflow of the spraying device. The paint from the second tank is provided in smaller amounts relative to the paint from the first tank.

The apparatus may be outfitted with a catalyst tank that supplies a catalyst directly to the spraying device. A gear pump may be used to pump catalyst from the catalyst tank to the spraying device. Gear pumps may also be used to pump paint from the paint tanks to the spraying device. The air tank may be used to provide pressurized air to the paint tanks. The apparatus may include a cleaner tank that provides cleaner to the gear pumps and to the hoses from the air tank to the spraying device.

The apparatus may be equipped with a third tank of paint that supplies paint to the outflow of the spraying device. The third tank may provide paint in smaller amounts relative to the first tank. When the third tank is present, it may be supplied with pressurized air from the air tank, or a gear pump may be used to pump paint from the tank to the spraying device. A cleaner tank may used to supply cleaner to the gear pump.

Additional features, advantages, and embodiments of the present disclosure may be set forth or apparent from consideration of the following detailed description, drawings, and claims. Moreover, it is to be understood that both the foregoing summary of the present disclosure and the following detailed description are exemplary and intended to provide further explanation without limiting the scope of the present disclosure as claimed.

BRIEF DESCRIPTION OF THE DRAWINGS

The accompanying drawings, which are included to provide a further understanding of the present disclosure, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced. In the drawings:

FIG. 2 shows an exemplary set of process variables;

DETAILED DESCRIPTION OF THE PRESENT DISCLOSURE

Figure 1:
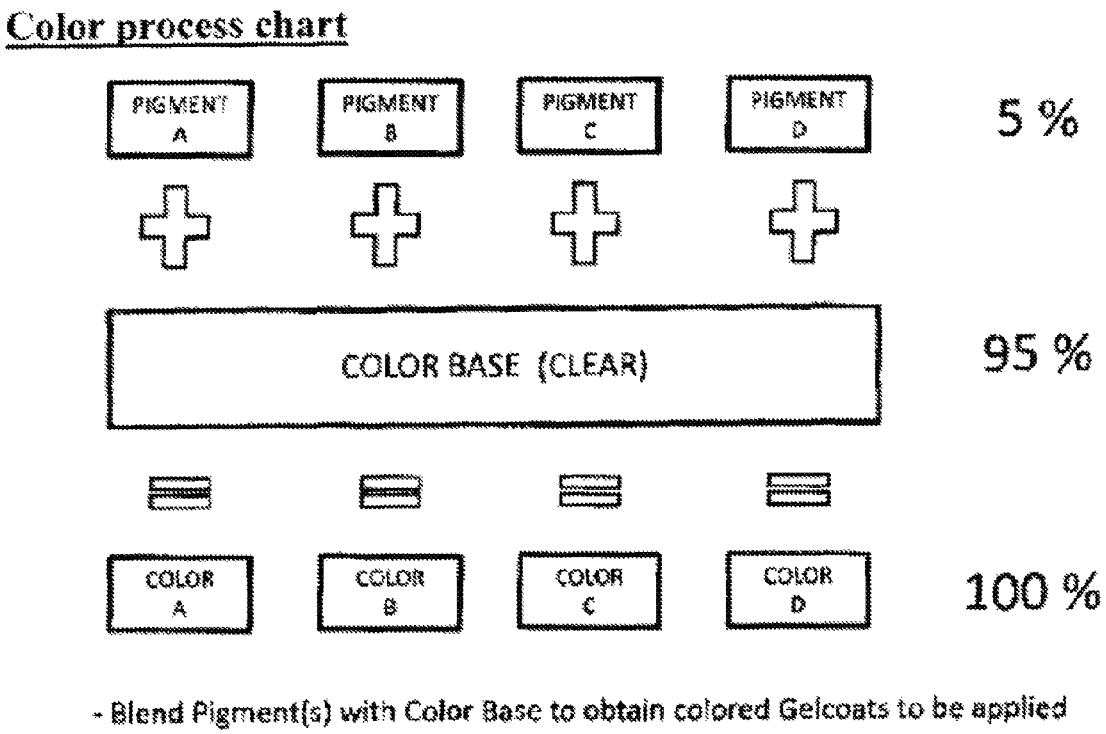
FIG. 1 shows a color process chart for producing a set of gelcoats.

The embodiments of the present disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the present disclosure. The examples used herein are intended merely to facilitate an understanding of ways in which the present disclosure may be practiced and to further enable those of skill in the art to practice the embodiments of the present disclosure. Accordingly, the examples and embodiments herein should not be construed as limiting the scope of the present disclosure, which is defined solely by the appended claims and applicable law. Moreover, it is noted that like reference numerals represent similar parts throughout the several views of the drawings.

According to a preferred aspect of the present disclosure, one or more pigments may be blended with a clear gelcoat base to produce one or more colors. The pigment may be a gelcoat, a paint, or the like. The base may be a clear color base, and more particularly may be a polyester base. The ratio of pigment to base may be adjusted as needed for the application at hand. As shown in FIG. 1, a preferred ratio is 5% pigment and 95% base, relative to the final gelcoat. Other ratios are possible, depending on the intended use and appearance of the desired application, as will be appreciated by one skilled in the art. Other pigments or base coat materials are contemplated.

FIG. 2 shows preferred values for assorted process variables for certain aspects of the present disclosure. The preferred viscosity of the liquid gelcoats may be between about 1850 and 3000, and the thixotropy may be between about 5.5 and 7.5. The preferred density of the gelcoats may be between about 1.1 and 1.5. The preferred temperature for applying the gelcoats is between about 26° C. and 30° C. The preferred air pressure for use in an air pressure-operated apparatus may be between about 80 PSI and 110 PSI. However, other ranges may be used. The present disclosure is further contemplated to be used with any type of application system, including air gun spraying systems, HVLP (high volume low pressure) systems, LVLP (low volume low pressure) systems, electrostatic spray painting systems, rotational bell systems, electric fan systems, air assisted airless spray gun systems, airless spray gun systems, automated linear spray systems, and the like.

Figure 3:
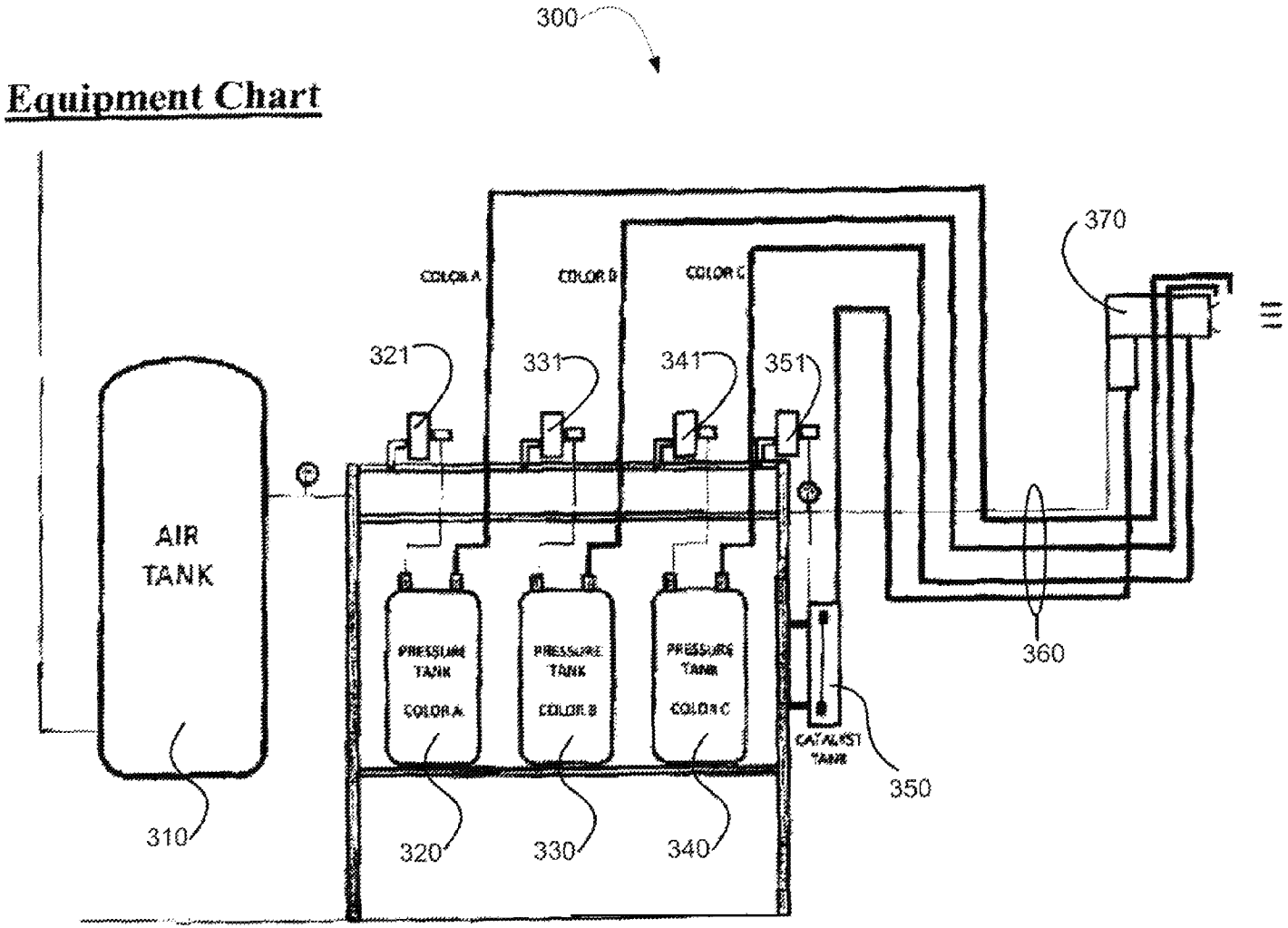
FIG. 3 shows a diagram of an apparatus capable of applying gelcoats to a surface.

FIG. 3 provides an example of an apparatus constructed according to an aspect of the present disclosure. Each pressure tank 320, 330, 340 contains a single colored gelcoat, labeled "Color A," "Color B," and "Color C." While only three pressure tanks 320, 330, 340 are shown in the figure, any number of pressure tanks may be used to achieve the desired result or effect. Pressurized air from an air tank 310 or other source may be passed into each pressure tank 320, 330, 340, driving the liquid colored gelcoat along a fluid line 360 toward a spraying device 370. The spraying device 370 may be any appropriate device known to one skilled in the art, such as, e.g., a fan, a nozzle, a vent, a duct, or the like. The spraying device 370 may also be a type of application system, including air gun spraying systems, HVLP (high volume low pressure) systems, LVLP (low volume low pressure) systems, electrostatic spray painting systems, rotational bell systems, electric fan systems, air assisted airless spray gun systems, airless spray gun systems, automated linear spray systems, and the like. This apparatus may also include other components, such as regulators 321, 331, 341, 351 to regulate the air pressure, filters to filter the air, and the like.

In the example shown in FIG. 3, Color C is the background color, although any pressure tank may be setup to provide the background color. The background color enters the spraying device 370 directly and is sprayed on the substrate in large, even amounts. Continuing the example in FIG. 3, Color A and Color B are the "point colors," although any pressure tank may be setup to provide a point color. These colors enter the outflow or airstream created by the spraying device 370 in small amounts relative to the background color. This arrangement results in the point colors being deposited on the substrate in small droplets, creating a unique pattern that may mimic the look of natural granite or other materials.

As the colors are applied to the substrate, they may be mixed with a catalyst. The catalyst, which may be stored in a tank 350, may act as a curing agent, for example, by polymerizing the gelcoat or otherwise increasing the percentage of solids in the coat. The catalyst may be any agent known to one skilled in the art. The catalyst may be applied in the range of 1.5-2.5% by weight of the color used or in any suitable amount according to the application at hand and desires of the user, as will be understood by one skilled in the art.

Variations in the pattern may be introduced by any means known to one skilled in the art. For example, the rate at which individual drops of each point color enter the spraying device's airflow may be regular or random. The overall rate of each point color may be changed over time, for example, by adjusting the valves regulating the pressure in each pressure tank or the valve regulating the flow of liquid gelcoat out of the pressure tanks. Such adjustment of valves may be accomplished by any means known to one skilled in the art. For example, the valves may be manually set and adjusted, controlled by mechanical means, or computer-controlled.

Figure 4:
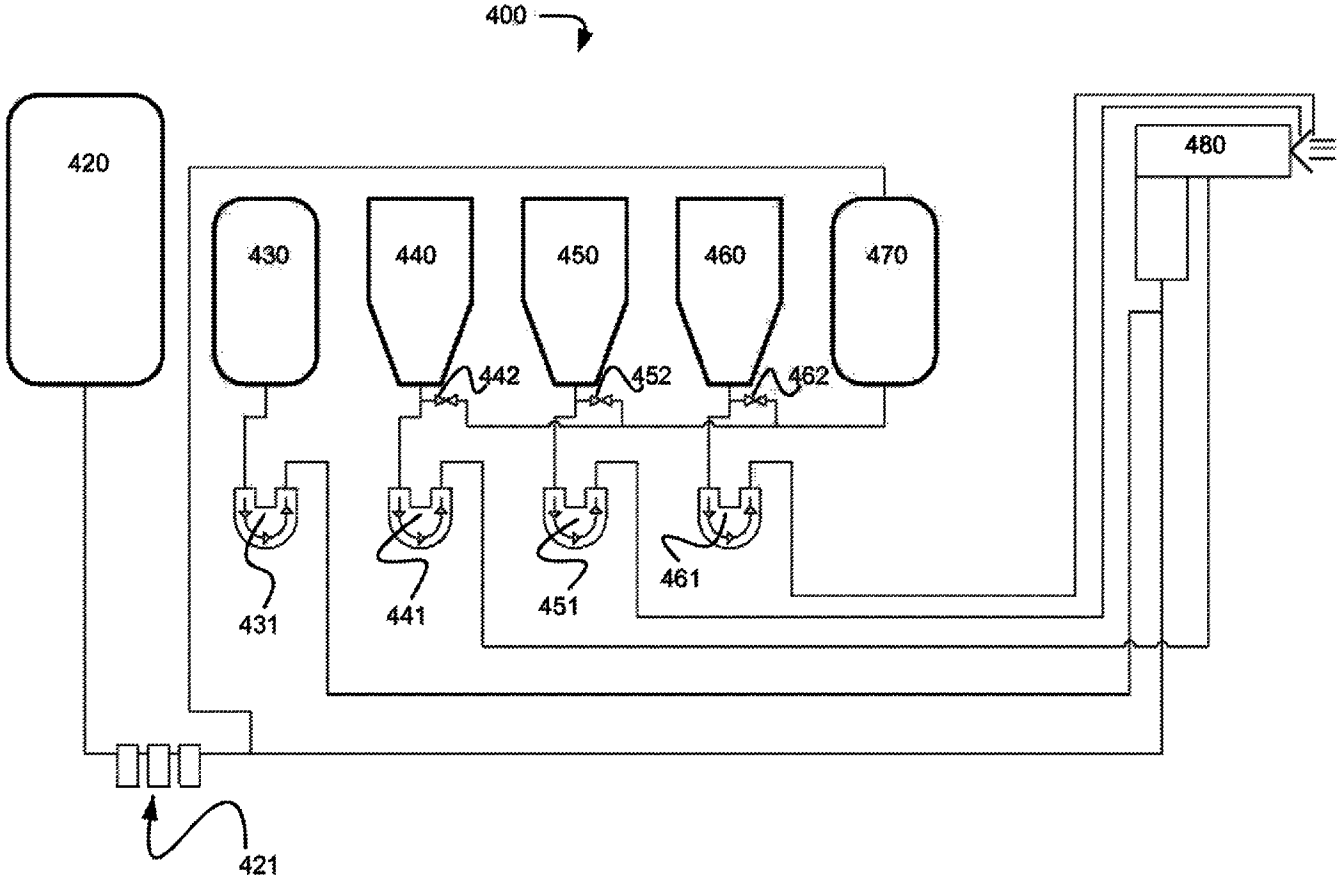
FIG. 4 shows a schematic of an alternate apparatus capable of applying gelcoats to a substrate, according to an aspect of the present disclosure.

FIG. 4 shows an additional aspect of the disclosure, including an alternate apparatus for practicing the present disclosure. The apparatus 400 may include air tank 420, catalyst tank 430, color tank 440, color tank 450, color tank 460, cleaner tank 470, and spraying device 480. While apparatus 400 is shown with 3 color tanks 440, 450, 460, the apparatus may have more or fewer color tanks, depending on the specific application at hand, without departing from the spirit and scope of the present disclosure and attached claims.

The air tank 420, which may include a compressed air maintenance unit 421, stores compressed air and provides the compressed air to spraying device 480. The spraying device 480 may be any appropriate device known to one skilled in the art, such as, e.g., a fan, a nozzle, a vent, a duct, or the like. The spraying device 480 may also be a type of application system, including air gun spraying systems, HVLP (high volume low pressure) systems, LVLP (low volume low pressure) systems, electrostatic spray painting systems, rotational bell systems, electric fan systems, air assisted airless spray gun systems, airless spray gun systems, automated linear spray systems, and the like.

Each color tank contains a single pigmented gelcoat. In the apparatus 400 shown in FIG. 4, color tank 440 is configured to provide color directly to the spraying device 480. This color may be sprayed on the substrate in large, even amounts, providing a background color. Color tanks 450 and 460 are configured to provide their colors to the outflow of the spraying device 480. These colors may be provided in smaller amounts relative to the background color, creating point colors on the background color. The flow of color from each tank may be provided or regulated by gear pumps 441, 451, and 461. Gear pumps are able to deliver small and varying amounts of color, creating greater variation in the resulting pattern. In addition, gear pumps are able to handle both smaller productions runs and larger production runs. Different arrangements of the color tanks 440, 450, 460 to provide background and point colors are contemplated and with the scope and spirit of the present disclosure and claims.

A catalyst may be stored in catalyst tank 430 and provided to the spraying device 480 via gear pump 431. The colors may be mixed with the catalyst in the spraying device or as they are being sprayed onto the substrate. The catalyst may act as a curing agent, for example, by polymerizing the gelcoat or otherwise increasing the percentage of solids in the coat. The catalyst may be any agent known to one skilled in the art. The catalyst may be applied in the range of 1.5-2.5% by weight of the color used or in any suitable amount according to the application at hand and desires of the user, as will be understood by one skilled in the art.

Cleaner tank 470 may hold a cleaning solution or agent that may be used to remove old or excess paint from gear pumps and other equipment when, for example, the color in a color tank is changed. Cleaning may also be part of regular maintenance of apparatus 400. Cleaner is provided from cleaning tank 470 to each of the color tanks' gear pumps by means of valves 442, 452, and 462. The valves may be closed during normal operation, but one or more may be opened at an appropriate time to clean the associated gear pump and line or hose to the spraying device 480. The cleaner tank 470 may also be configured to provider cleaner to the compressed air line for cleaning the line, as well as the spraying device.

Methods and apparatuses according to the present disclosure may produce either a regular, repeating pattern or an irregular, non-repeating pattern, depending on the particular application. A regular pattern may be more reminiscent of engineered stone or culture marble whereas an irregular pattern may be more similar to natural stone.

Suitable substrates may include, for example, natural wood, such as oak or pine; man-made composite wood, such as plywood, particle board, or medium density fiber board; plastic; plaster; ceramic; tile; fiber glass; and the like. According to aspects of the present disclosure, gelcoat paint may be applied to a substrate by painting the entire substrate at one time using one or more spraying devices, by moving the substrate past one or more fixed spraying devices, by moving one or more spraying devices around a fixed substrate, by moving both the substrate and one or more spraying devices, or any combination thereof. Examples of furniture and fixtures that may be painted by the present disclosure include, without limitation, a sink, a lavatory, a bath, a bidet, a urinal, a hot tub, a whirlpool bath, a cabinet, and a countertop. The process may also be applied to furniture elements or components that are intended to be assembled by the purchaser or end user.

While the present disclosure has been described in terms of exemplary embodiments and aspects, those skilled in the art will recognize that the present disclosure can be practiced with modifications in the spirit and scope of the appended claims. These examples given above are merely illustrative and are not meant to be an exhaustive list of all possible aspects, designs, embodiments, applications or modifications of the present disclosure.

What is claimed is:

1. An apparatus for applying a gelcoat to a substrate, the apparatus comprising:

a spraying device;

an air source configured to provide pressurized air to the spraying device;

a first tank configured to provide a first paint directly to the spraying device;

a second tank configured to provide a second paint to an outflow of the spraying device, the second paint provided in smaller amounts relative to the first paint, wherein the second paint does not enter the spraying device;

a first pump configured to pump paint from the first tank to the spraying device;

a second pump configured to pump paint from the second tank to the spraying device; and a cleaner tank configured to provide cleaner to the first pump, to the second pump, and to a hose from the air source to the spraying device.

2. The apparatus of claim 1, further comprising a catalyst tank configured to provide a catalyst directly to the spraying device.

3. The apparatus of claim 2, further comprising a gear pump configured to pump catalyst from the catalyst tank to the spraying device.

4. The apparatus of claim 1, further comprising a third tank configured to provide a third paint to the outflow of the spraying device, the third paint provided in smaller amounts relative to the first paint.

5. The apparatus of claim 4, further comprising a third pump configured to pump paint from the third tank to the spraying device.

6. The apparatus of claim 5, wherein the cleaner tank is further configured to provide cleaner to the third pump.

7. An apparatus for applying a gelcoat to a substrate, the apparatus comprising:

a spraying device;

an air source configured to provide pressurized air to the spraying device;

a first tank configured to provide a first paint directly to the spraying device;

a second tank configured to provide a second paint to an outflow of the spraying device, the second paint provided in smaller amounts relative to the first paint;

a first gear pump configured to pump paint from the first tank to the spraying device;

a second gear pump configured to pump paint from the second tank to the spraying device; and a cleaner tank configured to provide cleaner to the first gear pump, the second gear pump, and a hose from the air source to the spraying device.

8. An apparatus for applying a gelcoat to a substrate, the apparatus comprising:

a spraying device;

an air source configured to provide pressurized air to the spraying device;

a first gear pump configured to pump paint to the spraying device;

a second gear pump configured to pump paint to the spraying device; and a tank configured to provide cleaner to the first gear pump, the second gear pump and a hose from the air source to the spraying device.

9. The apparatus of claim 8, further comprising:

a third pump configured to pump paint to the spraying device.

10. The apparatus of claim 9, wherein the third pump comprises a gear pump.

* * * * *